US009207030B2

(12) United States Patent
Perrette, V et al.

(10) Patent No.: US 9,207,030 B2
(45) Date of Patent: Dec. 8, 2015

(54) FIREARM MAGAZINE AND METHOD OF MAKING SAME

(71) Applicants: Harry A. Perrette, V, Merritt Island, FL (US); Harry A. Perrette, IV, Cocoa, FL (US)

(72) Inventors: Harry A. Perrette, V, Merritt Island, FL (US); Harry A. Perrette, IV, Cocoa, FL (US)

( * ) Notice: Subject to any disclaimer, the term of this patent is extended or adjusted under 35 U.S.C. 154(b) by 0 days.

(21) Appl. No.: 13/694,254

(22) Filed: Nov. 13, 2012

(65) Prior Publication Data

US 2014/0130389 A1 May 15, 2014

(51) Int. Cl.
*F41A 9/71* (2006.01)
*F41A 9/70* (2006.01)

(52) U.S. Cl.
CPC .... *F41A 9/71* (2013.01); *F41A 9/70* (2013.01)

(58) Field of Classification Search
CPC ..... F41A 9/71; F41A 9/69; F41A 9/70; F41A 19/12; F41A 19/31
USPC ..... 42/50, 49.01–49.1, 17–18, 21–22, 24, 42/29, 33, 35, 37, 39, 6
See application file for complete search history.

(56) References Cited

U.S. PATENT DOCUMENTS 2,568,198 A * 9/1951 Loomis ..... F41A 17/38 89/140
2,601,735 A * 7/1952 Brush ..... F41A 9/02 42/17
2,655,754 A * 10/1953 Brush ..... F41A 9/67 42/18
2,690,024 A * 9/1954 Brush ..... F41A 9/17 42/49.01
2,801,485 A * 8/1957 Marsh ..... F41A 9/66 42/50
2,908,987 A * 10/1959 Allyn ..... F41A 9/65 124/52
2,922,240 A * 1/1960 Allyn ..... F41A 3/32 42/16
3,094,803 A * 6/1963 Green ..... F41A 9/41 42/18
3,167,876 A * 2/1965 Milroy, Jr. ..... F41A 9/17 42/18
3,377,732 A * 4/1968 Bivens ..... F41A 9/83 42/50
3,711,981 A * 1/1973 Seecamp ..... F41A 9/69 42/50
3,745,687 A * 7/1973 Koon, Jr. ..... F41A 9/26 42/19
4,079,535 A * 3/1978 Elbe et al. ..... F41A 11/02 42/49.02
4,286,499 A * 9/1981 Gillum ..... F41A 9/54 42/18

(Continued)

*Primary Examiner* — Michael David
(74) *Attorney, Agent, or Firm* — Brian S. Steinberger; Law Offices of Brian S. Steinberger, P.A.

(57) ABSTRACT

A box magazine (10) has a body portion 11 formed from a first section (12) including a side (14) and spaced-apart, upstanding edges (16) and (18) and a second section (20) that has a side (22) and spaced-apart, upstanding rims (24) and (26). A "Z" shaped keys (28) are formed in each of the spaced-apart, upstanding edges (16) and (18) and matching "Z: shaped keyways (30) are formed in each of the spaced-apart, upstanding rims (24) and (26). The keys (28) and keyways (30) engage one another via a sliding action to form the body portion (11). A follower (32) is positioned between the first section (12) and the second section (20), a follower spring (34) is positioned between the first section (12) and the second section (20) and has a first end (36) in contact with the follower (32) and a second end (38) in contact with a floor plate (40) that seals a bottom (42) of the body portion (11) to form the box magazine (10).

6 Claims, 3 Drawing Sheets

(56) References Cited

U.S. PATENT DOCUMENTS 4,416,186 A * 11/1983 Sullivan ..... F41A 3/26 89/198
4,475,437 A * 10/1984 Sullivan ..... F41A 3/72 42/70.06
4,502,367 A * 3/1985 Sullivan ..... F41A 3/72 89/181
4,505,182 A * 3/1985 Sullivan ..... F41A 3/72 42/69.02
4,707,941 A * 11/1987 Eastman ..... F41A 9/68 42/49.02
4,744,164 A * 5/1988 Rieger ..... F41A 9/17 42/18
4,907,362 A * 3/1990 Hobbie ..... F41A 9/55 42/49.02
5,027,541 A * 7/1991 Velezis ..... F41A 9/62 42/18
5,056,252 A * 10/1991 Velezis ..... F41A 9/62 42/18
5,235,769 A * 8/1993 Stead ..... F41A 9/17 42/11
5,329,718 A * 7/1994 Howard ..... F41A 9/69 42/50
5,465,519 A * 11/1995 Blanck ..... F41A 17/44 42/70.01
6,591,535 B2 * 7/2003 Reynolds ..... F41A 9/19 42/105
8,006,424 B1 * 8/2011 Ligard ..... F41A 17/02 211/64
8,061,255 B1 * 11/2011 Boberg ..... F41A 9/23 42/16
2002/0152662 A1 * 10/2002 Lane ..... F41A 17/44 42/70.11
2005/0115131 A1 * 6/2005 Markbreit ..... F41A 17/44 42/70.11
2010/0175547 A1 * 7/2010 Hoffman ..... F41A 7/08 89/9
2012/0066950 A1 * 3/2012 Davidson ..... F41A 9/70 42/50
2014/0075808 A1 * 3/2014 Ballard ..... F41A 9/70 42/49.01

* cited by examiner

FIREARM MAGAZINE AND METHOD OF MAKING SAME

CROSS-REFERENCE TO RELATED APPLICATIONS

This application claims priority from Provisional Patent Application Ser. No. 61/632,507, filed Jan. 25, 2012.

GOVERNMENT CONTRACT

This invention was not made under any government contract and the United States Government has no rights under this invention.

TECHNICAL FIELD

This invention relates to magazines for firearms, particularly handguns. More specifically, it relates to a magazine for a handguns used as a part of conversion kit for converting a firearm from one cartridge size to another and to a method for making the magazine.

BACKGROUND ART

An increasing number of manufacturers provide conversion kits for changing a particular caliber of weapon, particularly handguns, from one caliber to another. For example conversion kits are known for converting weapons that normally fire 9 mm ammunition to a weapon that will fire, for example, 22 caliber cartridges. Such a practice allows a user to practice with a weapon of choice while using much less expensive ammunition. Generally, the conversion kit includes at least a new barrel and slide and a magazine for carrying the new ammunition. In the past, such magazines have been created from a sheet steel material that is bent into a box-shape or from a molded plastic material. Both of these approaches entail difficulties in manufacturing, particularly in maintaining tolerances.

DISCLOSURE OF INVENTION

It is, therefore, an object of the invention to obviate the above enumerated disadvantages of the prior art.

It is another object of the invention to enhance box magazines for firearms.

Yet another object of the invention is the improvement of such box magazines.

These object are accomplished, in one aspect of the invention, by the provision of box magazine that comprises a first section having a side and spaced-apart, upstanding edges.

A second, mating section also has a side and spaced-apart, upstanding rims. A "Z" shaped key is formed in each of the spaced-apart, upstanding edges and matching "Z" shaped keyways are formed in each of the spaced-apart, upstanding rims, the key and keyway engaging one by sliding the key and keyways together to form a hollow structure. A follower is positioned between the first section and the second section and a follower spring also is positioned between the first section and second section. The follower spring has a first end in contact with the follower and a second end in contact with a floor plate that seals a bottom of the box magazine. The sections are preferably machined from aluminum stock, thus allowing for the maintenance of the critical tolerances required. The box magazine thus produced is extremely rugged and capable of very long and dependable usage.

BEST MODE FOR CARRYING OUT THE INVENTION

Figure 1:
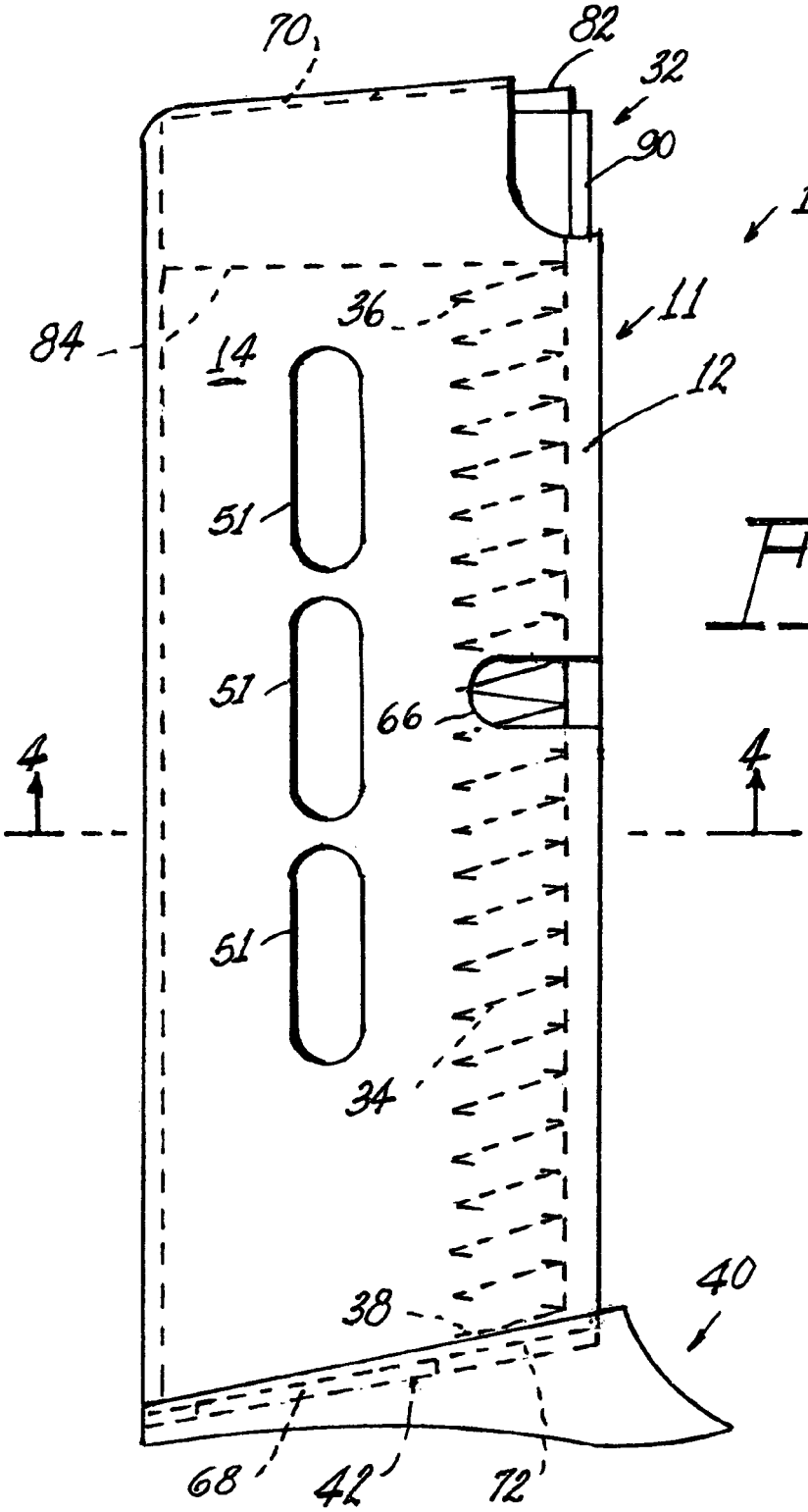
FIG. 1 is an elevation view of a magazine in accordance with an aspect of the invention.

For purposes of this application it is to be understood that when an element or layer is referred to as being "on," "connected to" or "coupled to" another element or layer, it can be directly on, connected to or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. The term "and/or" includes any and all combinations of one or more of the associated listed items.

Although the terms "first," "second," "third" etc. may be used to describe various elements, components, regions, layers and/or sections, these elements, components, regions, layers and/or sections are not to be limited by theses terms as they are used only to distinguish one element, component, region, layer or section from another element, component, region, layer or section. Thus, a first element, component, region, layer or section could be termed a second element, component, region, layer or section without departing from the scope and teachings of the present invention.

Spatially relative terms, such as "beneath," below," upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. For example, as used herein, the singular forms "a," "an" and "the" are intended to include the plural forms as well, unless the context clearly indicates otherwise. It will be further understood that the terms, "comprises" and/or "comprising," when used in this specification, specify the presence of stated features, integers, steps operations, elements, and/or components, but do not preclude the presence or addition of one or more other features, integers, steps, operations, elements, components, and/or groups thereof.

For a better understanding of the present invention, together with other and further objects, advantages and capabilities thereof, reference is made to the following disclosure and appended claims taken in conjunction with the above-described drawings.

Figure 2:
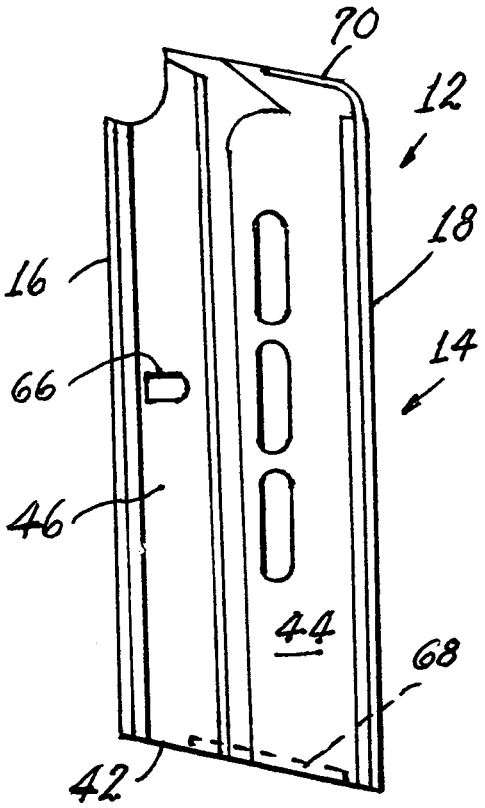
FIGS. 2 and 3 are elevation views of the interiors of the first and second sections of a magazine in accordance with an aspect of the invention.
Figure 3:
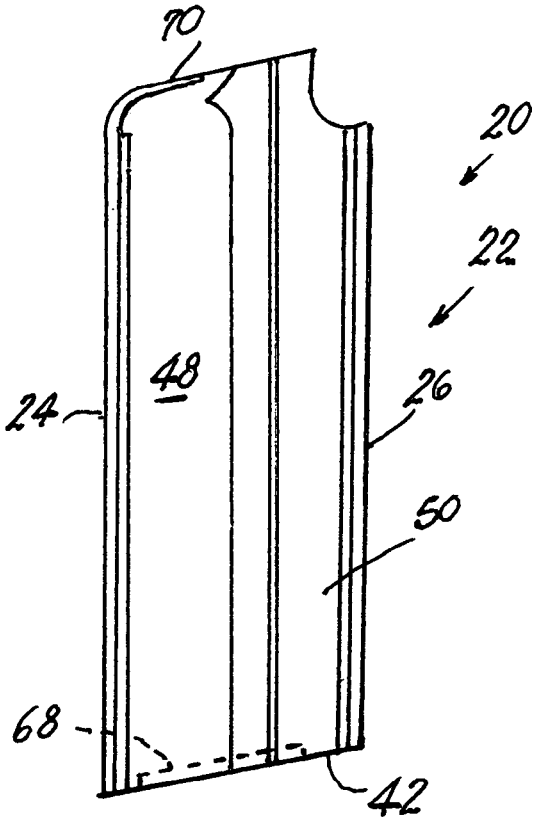

Referring now to the drawings with greater particularity, there is shown in FIG. 1 a box magazine 10. The magazine 10 has a body portion 11 that comprises a first section 12 having a side 14 and spaced-apart, upstanding edges 16 and 18 and is shown in FIG. 2 and a second section 20 having a side 22 and spaced-apart, upstanding rims 24 and 26. The second section 20 is shown in FIG. 3.

Figure 4:
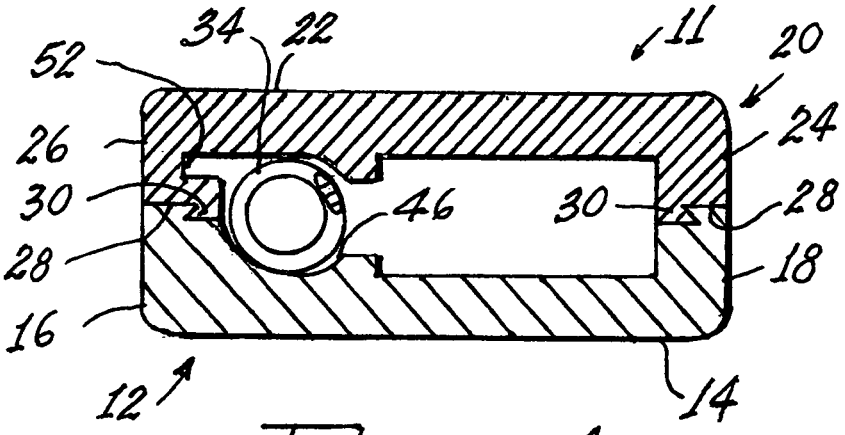
FIG. 4 is a sectional view taken along the line 4-4 of FIG. 1.
Figure 5:
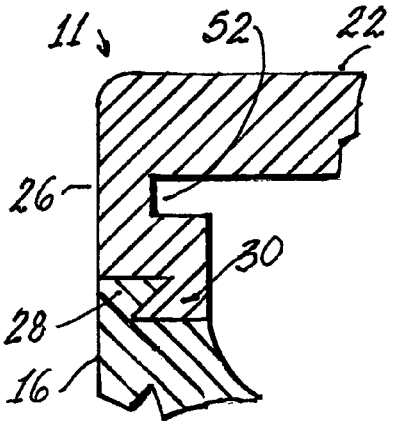
FIG. 5 is an enlarged partial sectional view of the key and keyway jointure of the sections of the magazine.
Figure 6:
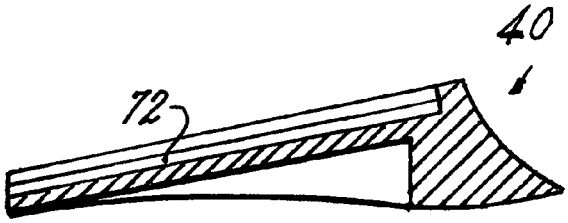
FIG. 6 is an elevation view, partially in section of floor plate for use in an embodiment of the invention.

A "Z" shaped key 28 is formed in each of the spaced-apart, upstanding edges 16 and 18 and matching "Z: shaped keyways 30 are formed in each of the spaced-apart, upstanding rims 24 and 26, the keys 28 and the keyways 30 engaging one another via a sliding action to form the body portion 11. The fitted junction of the keys 28 and the keyways 30 is shown in FIG. 4 and in an enlarged, partial sectional view, in FIG. 5.

A follower 32 is positioned in the body portion 11 between the first section 12 and the second section 20 and a follower spring 34 is positioned between the first section 12 and the second section 20 and has a first end 36 in contact with the follower 32 and a second end 38 in contact with a floor plate 40 that seals a bottom 42 of the body portion 11.

Figure 7:
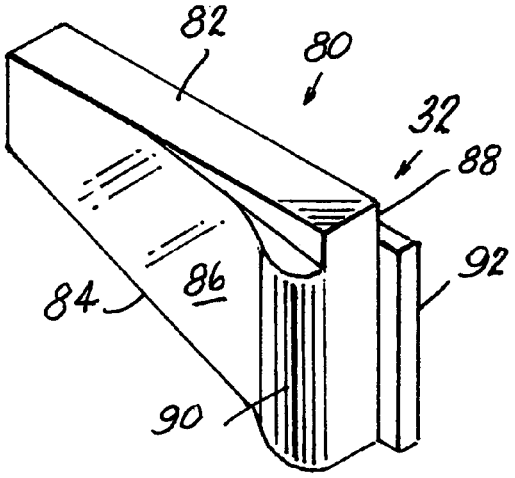
FIG. 7 is a perspective view of a follower for use in an embodiment of the invention.

The follower 32 (shown in FIG. 7) comprises a body 80 having an upper surface 82, which, in use, will be in contact with the first cartridge to be loaded into the magazine, a lower surface 84, oppositely disposed sides 86, 88; and a semi-circular protuberance 90 formed on the side 86 and a substantially rectangular protuberance 92 formed on the side 88.

The first section 12 has an inside surface 44 with at least one follower-orienting channel 46 formed therein. In a preferred embodiment of the invention the follower-orienting channel 46 is semi-circular.

The second section 20 has an inside surface 48 having a follower-orienting channel 50 and a follower-orienting groove 52 formed in the rim 26. In a preferred embodiment of the invention the first and second sections 12 and 20 are formed from machined aluminum, thus permitting close control of the necessary tolerances. Both of the upper ends of the first and second sections 12 and 20 are provided with at least partially inwardly extending ribs 70 that act to constrain the follower 32 from leaving the body 11.

Figure 8:
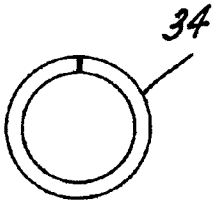
FIG. 8 is plan view of a follower spring for use in an embodiment of the invention.

When the follower 32 is inserted into the body 11 the upper surface 82 thereof contacts the ribs 70 of the body 11 and the semi-circular protuberance 90 fits into the follower-orienting channel 46 and the substantially rectangular protuberance 92 is fitted into the follower-orienting groove 52. These features provide a rigid orientation for the follower 32, permitting only movement along the longitudinal axis of the magazine and further allows the use of a follower spring 34 that is circular in cross-section, as is shown FIGS. 4 and 8. Prior art follower springs are generally more rectangular in cross-section in order to support the follower and keep it in proper orientation within the sheet metal body that has smooth interior surfaces. The spring 34 also is constrained by the channel 46 and the counterpart channel 50 formed on the inside surface 48 of second section 20. As is the usual practice, an aperture 66 is formed in at least one section of the body, for example, first section 12, to engage and cooperate with the magazine release mechanism included with the firearm. One or more cartridge viewing ports 51 can be provided in one of the sections.

After the insertion of the follower 32 and the follower spring 34 the floor plate 40 is affixed to the bottom 42 of the magazine 10. To accomplish this feat, the bottom 42 of the magazine 10 includes outwardly projecting flanges 68 and the floor plate 40 includes flange-receiving slots 72.

Thus there is provided a box magazine that is rugged and suitable for long usage.

While there have been shown and described what are at present considered to be the preferred embodiments of the invention, it will be apparent to those skilled in the art that various changes and modifications can be made herein without departing from the scope of the invention as defined by the appended claims.

GLOSSARY OF REFERENCE NUMBERS USED HEREIN

| | |
|---|---|
| 10 | magazine |
| 11 | body portion |
| 12 | first section |
| 14 | first side |
| 16 | edge on 14 |
| 18 | edge on 14 |
| 20 | second section |
| 22 | rim on 20 |
| 24 | rim on 20 |
| 26 | first edge |
| 28 | key |
| 30 | keyway |
| 32 | follower |
| 34 | follower spring |
| 36 | first end of 34 |
| 38 | second end of 34 |
| 40 | floor plate |
| 42 | bottom of magazine 10 |
| 44 | inside surface of 12 |
| 46 | channel in 12 |
| 48 | inside surface of 20 |
| 50 | channel in 20 |
| 51 | cartridge viewing port |
| 52 | groove in 28 |
| 66 | magazine release aperture |
| 68 | flanges on body 12 |
| 70 | ribs on body |
| 72 | slots in 40 |
| 82 | upper surface of 32 |
| 84 | bottom of 32 |
| 86 | first side of body |
| 88 | second side of body 80 |
| 90 | semi-circular protuberance |
| 92 | rectangular protuberance |

What is claimed is:

1. A firearm box magazine (10) comprising; a body (11) comprised of; a first section (12) having a side (14) and spaced-apart, upstanding edges (16, 18); a second section (20) having a side (22) and spaced-apart, upstanding rims (24, 26); a "Z" shaped keys (28) formed in each of said spaced-apart, upstanding edges (16, 18) and matching "Z: shaped keyways (30) formed in each of said spaced-apart, upstanding rims (24, 26), said keys (28) and said keyways (30) engaging one another to form said body (11); a follower (32) positioned between said first section (12) and said second section (20) within said body (11); and a follower spring (34) positioned between said first section (12) and said second section (20) and having a first end (36) in contact with said follower (32) and a second end (38) in contact with a floor plate (40) that seals a bottom (42) of said body (11) to form said box magazine (10).

2. The box magazine (10) of claim 1 wherein said first section (12) has an inside surface (44) having at least one follower-orienting channel (46) formed therein.

3. The box magazine (10) of claim 2 wherein said at least one follower-orienting channel (46) is semi-circular.

4. The box magazine (10) of claim 2 wherein said second section (20) has an inside surface (48) having a follower-orienting channel (50) and a follower-orienting groove (52) formed in said rim (26).

5. The box magazine (10) of claim 1 wherein said follower spring (34) is circular in cross-section.

6. A method of making a box magazine (10) for a firearm comprising the steps of: forming a first section (12) and a second section (20), said first section (12) having upstanding edges (16, 18) formed with "Z" shaped keys (28) therein and said second section (20) having upstanding rims (24, 26) with "Z" shaped keyways (30) formed therein; forming a follower (32); forming a follower spring (34); forming a floor plate (40): assembling said box magazine (10) by a relative sliding movement of said first section (12) and said second section (20) to engage said keys (28) and said keyways (30) to form a body portion (11), inserting said follower (32) into said body portion (11); inserting said follower spring (34) into said body portion (11) and sealing said body portion (11) by closing the bottom (42) thereof with a floor plate (40) to form said box magazine (10).

* * * * *